US005277683A

United States Patent [19]

Wilkins

[11] Patent Number: 5,277,683

[45] Date of Patent: Jan. 11, 1994

[54] TOTAL GYM

[76] Inventor: Chester Wilkins, P.O. Box 243, Pendleton, Ind. 46064

[21] Appl. No.: 985,260

[22] Filed: Dec. 3, 1992

[51] Int. Cl.[5] ..... A63B 21/04

[52] U.S. Cl. ..... 482/129; 482/92; 482/121

[58] Field of Search ..... 482/904, 126, 49, 129, 482/121, 13, 39, 79, 92, 148

[56] References Cited

U.S. PATENT DOCUMENTS

| | | | |
|---|---|---|---|
| 650,656 | 5/1900 | Raabe . | |
| 3,256,015 | 6/1966 | Perrin . | |
| 3,528,656 | 9/1970 | Karl | 482/126 |
| 4,195,835 | 4/1980 | Hinds et al. . | |
| 4,325,548 | 4/1982 | Piccini . | |
| 4,326,708 | 4/1982 | Hinds . | |
| 4,328,964 | 5/1982 | Walls | 482/129 |
| 4,427,023 | 2/1984 | Silberman . | |
| 4,611,805 | 9/1986 | Franklin et al. . | |

FOREIGN PATENT DOCUMENTS

| | | | |
|---|---|---|---|
| 179915 | 10/1906 | Fed. Rep. of Germany . | |
| 2403088 | 5/1979 | France . | |
| 84639 | 3/1920 | Switzerland | 482/126 |
| 0388833 | 6/1965 | Switzerland | 482/904 |
| 2227949 | 8/1990 | United Kingdom . | |

*Primary Examiner*—Richard J. Apley
*Assistant Examiner*—Jerome Donnelly
*Attorney, Agent, or Firm*—Richard C. Litman

[57] ABSTRACT

This invention relates to a portable, safe, easy, and effective device for exercising. The device includes a series of components usable together in numerous combinations so as to provide a total physical workout. The components are capable of being transported in a small attache case or gym bag. The exercise device may be used for exercising the upper portion of the body, including hands, arms and upper torso, with a stationary door frame or portable foot plate providing the anchor resistance. Alternately, the legs, ankles and lower torso may be exercised while seated on an ordinary chair or bench with an ordinary door providing the anchor resistance. Multiple elastic bands, cables or springs provide adjustable resistance to movement in all forms of the invention.

12 Claims, 8 Drawing Sheets

FIG. 1A
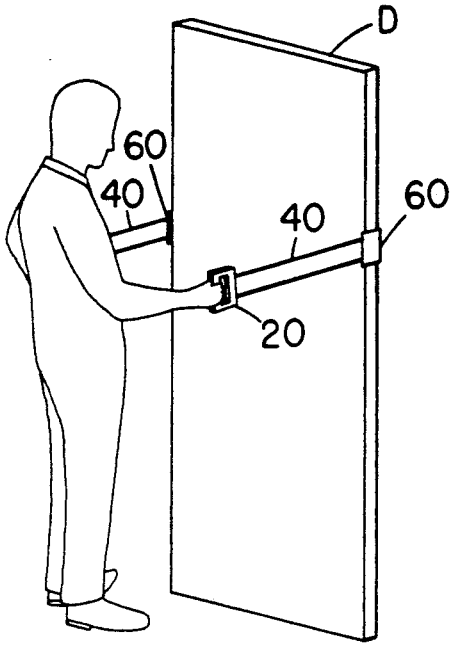
FIG. 1B
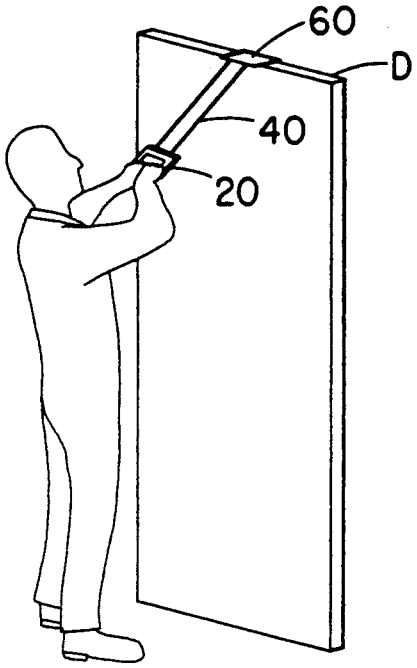
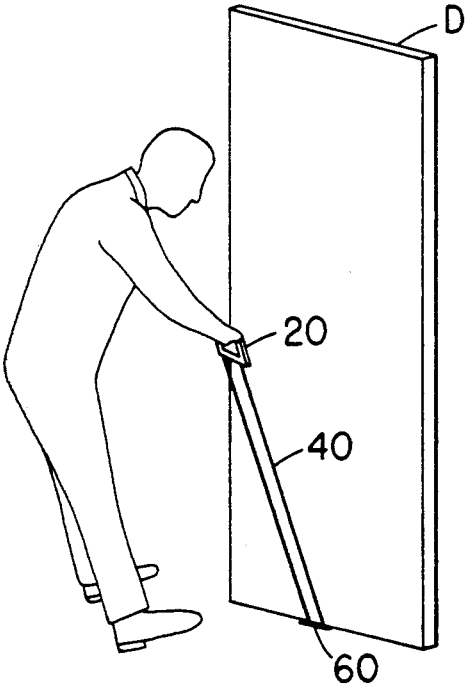
FIG. 1C
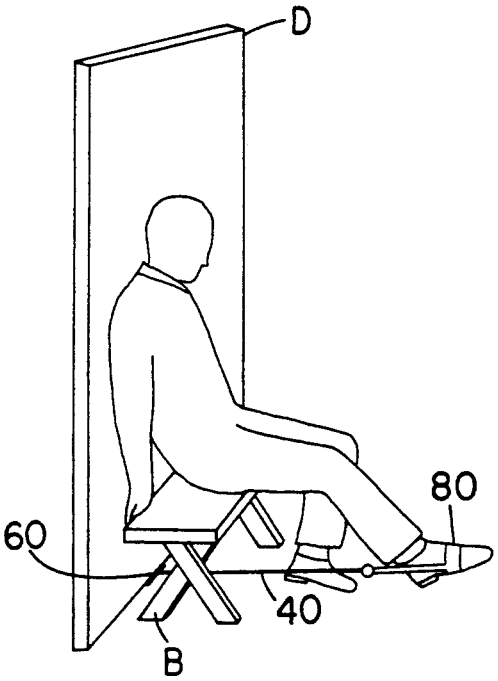
FIG. 1D

TOTAL GYM

BACKGROUND OF THE INVENTION

1. Field of the Invention

This invention relates to a portable, safe, easy, and effective device for exercising. The device includes a series of components usable together in numerous combinations so as to provide a total physical workout. The components are capable of being transported in a small attache case or gym bag. The exercise device may be used for exercising the upper portion of the body, including hands, arms and upper torso, with a stationary door frame or portable foot plate providing the anchor resistance. Alternately, the legs, ankles and lower torso may be exercised while seated on an ordinary chair or bench with an ordinary door providing the anchor resistance. Multiple elastic bands, cables or springs provide adjustable resistance to movement in all forms of the invention.

2. Description of the Prior Art

A plethora of exercise devices are prevalent on the market these days. The majority of the full body exercise devices require a substantial area to use and set up. Moving them from one location to another is out of the realm of convenience. Elastic band exercisers eliminate the need for heavy weights to provide resistance to motion but still ordinarily require a large workout area. The framework necessary to provide rigid anchor points for the elastic bands from above, below, front, back, and both sides constitutes the major structural elements of such devices. My invention provides a much simpler way to get the same exercise with less expense and greater portability. An existing door may be used in place of the traditional framework elements. The traditional iron weights, used to provide an adjustable resistance to motion, can be effectively replaced with multiple elastic straps of which one or several may be used to create the same adjustable resistance to motion. Portable elastic exercise devices are known in the prior art.

U.S. Pat. No. 4,195,835 issued Apr. 1, 1980 to Robert S. Hinds et al discloses an elastic cable exerciser bar. The fixed anchor point is provided by a foot engaging loop which differs substantially from my proposed foot plates.

U.S. Pat. No. 4,326,708 issued Apr. 27, 1982 to Robert S. Hinds describes a method of using the above elastic cable exerciser bar. Pretensioning of the elastic cable to provide more resistance is accomplished by winding the cable around the bar. My invention has no need of such pretensioning as additional cables may be added to provide more resistance.

U.S. Pat. No. 650,656 issued May 29, 1900 to Julius A. Raabe shows an elastic band exerciser connected to both the hands and feet and anchored in hook members on the back of a body harness. In contrast my invention uses a more permanent form of anchor such as an existing door frame or a solid foot plate resting upon the floor.

U.S. Pat. No. 3,256,015 issued Jun. 14, 1966 to William E. Perrin shows an elastic strap exerciser having a shoe holster and an anchor which wedges beneath an existing door. The door anchor differs form mine in that only one strap may be anchored and that it may not be used on the sides or top of the door.

U.S. Pat. No. 4,611,805 issued Sep. 16, 1986 to Irving H. Franklin et al shows an elastic cord exercise device wherein multiple straps may be connected to hand grips and anchored to a door mounted support bracket. The support bracket is not suitable for attaching to the top or sides of a door as is the bracket of my invention.

U.S. Pat. No. 3,427,023 issued Feb. 11, 1969 to Ira J. Silberman discloses and an elastic cord exercise device which has a hand grip designed to easily accommodate multiple cords.

U.S. Pat. No. 4,325,548 issued Apr. 20, 1982 to Silvio D. Piccini shows a kick exercise device which includes a foot holster and is anchored to a post.

French Patent No. 2,403,088 issued May 18, 1979 to Charles Dehan shows an elastic exercise device with two hand grips and two door hooks. The hooks and grips do not provide for attachment of multiple straps as does my invention.

United Kingdom Patent Application 2,227,949 by Raymond Green published on Aug. 15, 1990 shows an elastic spring exerciser comprising a door hook and a cushioned ankle collar. The hook and collar do not provide for attachment of multiple straps as does my invention.

German Patent No. 176,915 issued Oct. 25, 1906 to Nachmen Stein shows a general purpose exercise device with multiple straps, foot plates, hand grips, etc. The exercise device is not portable as is my invention.

None of the above inventions and patents, taken either singly or in combination, is seen to describe the instant invention as claimed.

SUMMARY OF THE INVENTION

With the current emphasis on having a healthy body coupled with the increasing sedentary demands of daily living which tend to reduce the amount of time available for exercise, there is a need for a portable exercise device which may be anchored to a rigid object which is readily available at almost any location. As indicated above, there are a number of portable exercise devices on the market. However, none of the known devices have the ease of construction, storage, and portability exhibited by the instant invention.

Accordingly, it is a principal object of this invention to provide a portable exercise device which may be quickly assembled and disassembled as well as easily transported from one location to another.

It is another object of the invention to provide a portable exercise device which is capable of providing a full body workout while requiring minimal area for use and enjoyment.

It is a further object of the invention to provide a portable exercise device capable of providing adjustable resistance to motion for various strength users or various types of exercise.

It is another object of this invention to provide a portable exercise device having elastic bands which provide a linear resistive force from a plurality directions including from directly below so as to simulate the lifting of weights.

Still another object of the invention is to provide a portable exercise device which may be packaged and sold in kit form so as to allow a user to begin with minimal equipment and gradually add individual items to provide a total gym.

It is a final object of the invention to provide improved elements and arrangements thereof in an apparatus for the purposes described which is inexpensive, dependable and fully effective in accomplishing its intended purposes.

Other objects, features and advantages of this invention will become readily apparent from the following detailed description and the appended claims, reference being had to the accompanying drawings forming a part of the specification, wherein like reference numerals designate corresponding parts throughout the several views.

BRIEF DESCRIPTION OF THE DRAWINGS

FIGS. 1A-1D are environmental perspective views illustrating some of the many ways the exercise device of this invention may be used.

Similar reference characters denote corresponding features consistently throughout the attached drawings.

DETAILED DESCRIPTION OF THE PREFERRED EMBODIMENT(S)

Figure 2:
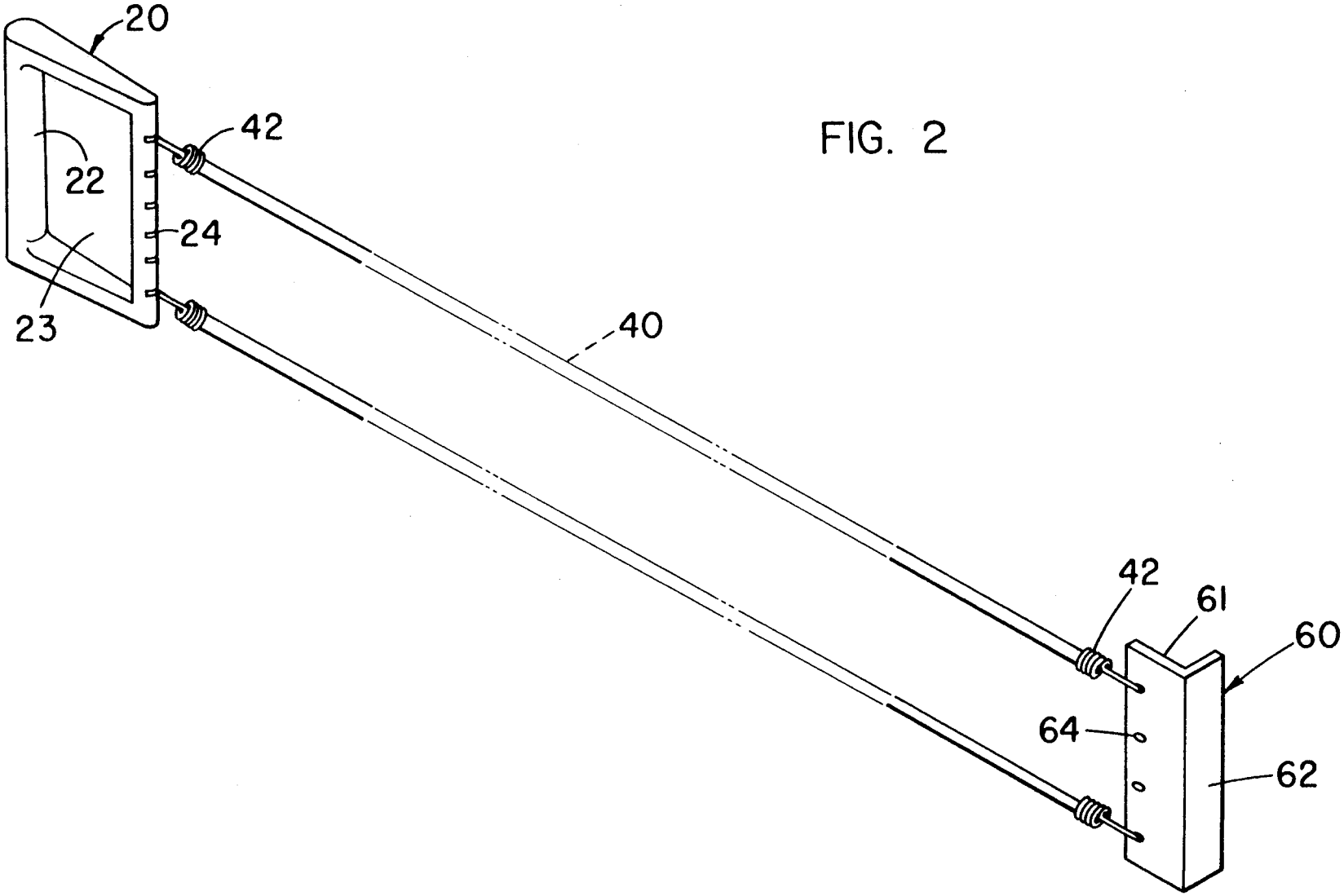
FIG. 2 is a perspective view of three major parts of the invention the handgrip, elastic bands, and door anchor bracket.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

FIGS. 1A through 1C show various exercises being performed with the simplest form of the invention. Generally handgrips 20 are connected to multiple elastic bands 40 which are connected to anchor brackets 60 which are held in place at various points around the periphery of a conventional existing door D. Brackets 60 are simply placed upon door D when it is in the open position and then the door D is closed in the normal fashion. The clearance around the door jamb of most ordinary doors is sufficient to accommodate the relatively narrow thickness of bracket 60. FIG. 1A shows two devices, one attached to each side of a door D, which may be grasped by both hands of the user while facing the door D and alternately or simultaneously pulling handgrips 20. As the grips 20 are pulled away from the door D elastic bands 40 are forced to increase in length. Of course the user could face away from the door and grasp these two bands 40 to change the muscles being exercised. This exercise should provide an excellent workout for the biceps, triceps, and shoulder muscles.

FIG. 1B shows a single exercise device attached to the top of a door D which is being grasped and pulled downward by both hands of the user. Of course the user could face away from the door D with this setup also. This exercise should provide an excellent workout for the pectoral and shoulder muscles.

FIG. 1C shows a single exercise device attached to the bottom of a door D which is being grasped and pulled upward by both hands of a user. Of course the user could also face away from the door D and stretch the bands 40 upward and forward from between or beside their legs. This exercise should provide an excellent workout for the lower back and shoulder muscles.

The elasticity of the bands 40 creates a counter force which is generally proportional to the distance the band 40 has been stretched. For example, if a force of 10 pounds stretches a single band 40 1 inch then a force of 20 pounds would stretch the same band 40 a distance of 2 inches. In this case we would say the elasticity of the band 40 was 10 pounds per inch. To stretch such a band 40 6 inches from its free length would require a force of 60 pounds. The energy expended in such an effort would be 180 inch-pounds or 15 foot-pounds.

To increase the energy expenditure, the exercise device may be modified in many ways. The first, and a crucial feature of this invention, is to simply add another elastic band 40 to the handgrip. The force required to stretch two elastic bands 40 6 inches, as in the above example, would be 120 pounds or just double as one might expect. The energy expended with two bands 40 is also doubled and would be 360 inch pounds or 30 foot-pounds. It is contemplated that as many as 10 elastic bands 40 could be attached to a single handgrip unit 20 and anchored by a single anchor bracket 60.

Another way to increase the energy expenditure while using the device would be to preload the elastic band 40 before beginning the exercise. For example in using the device shown in FIG. 1A the user could back away from the door 6 inches before beginning the exercise so that the bands 40 are preloaded a distance of 6 inches. Stretching a single band 40 as above an additional 6 inches beyond the 6 inch preload distance would require a force of 120 pounds. Again the force required would just be doubled which is to be expected since the overall stretched length is just twice as much. However, not so obvious is the fact that the energy expended in doing this preloaded exercise is 540 inch-pounds or 45 foot-pounds per cable. Thus by the simple expedient of backing away from the door D slightly to preload the elastic bands 40 the user can increase the energy expended in the same exercise by a factor of 3 or more. The same principle applies to all the elastic band exercises that may be done with this elastic band exerciser. As another even more dramatic example of the advantage of preload let us consider the following setup for exercising the quadracep or thigh muscle. For this purpose the user would connect the anchor bracket 60 to the top of a door as shown in FIG. 1B. With his back to the door D the user would then pull handgrip 20 down till a foot could be inserted into the handgrip opening. The exercise could then be accomplished by pressing the foot downward to the floor utilizing the thigh muscles. It is well known the quadracep muscle is the second strongest and bulkiest muscle in the human body so significant systemic effects can be accomplished in a short time period. For purposes of example we might assume the following: A single band 40 with only a 1 pound per inch elasticity (one tenth of the stiffness used above) and a free length of 2 feet might be hung from the top of a 7 foot door. The band 40 would be pulled down to 1 foot above the floor where the foot could be inserted. This amounts to a preload distance of 4 feet or a preload force of 48 pounds. The 1 foot stretch imposed by the leg muscle would require an energy expenditure of 54 foot-pounds per cable. Nearly one tenth of a horsepower would be required to perform this stretch in one second. Thus ten such cables could absorb energy at a rate of nearly one full horsepower! The exercise device of this invention is thus easily capable of providing a vigorous workout without requiring the use of excessive forces.

Figure 3:
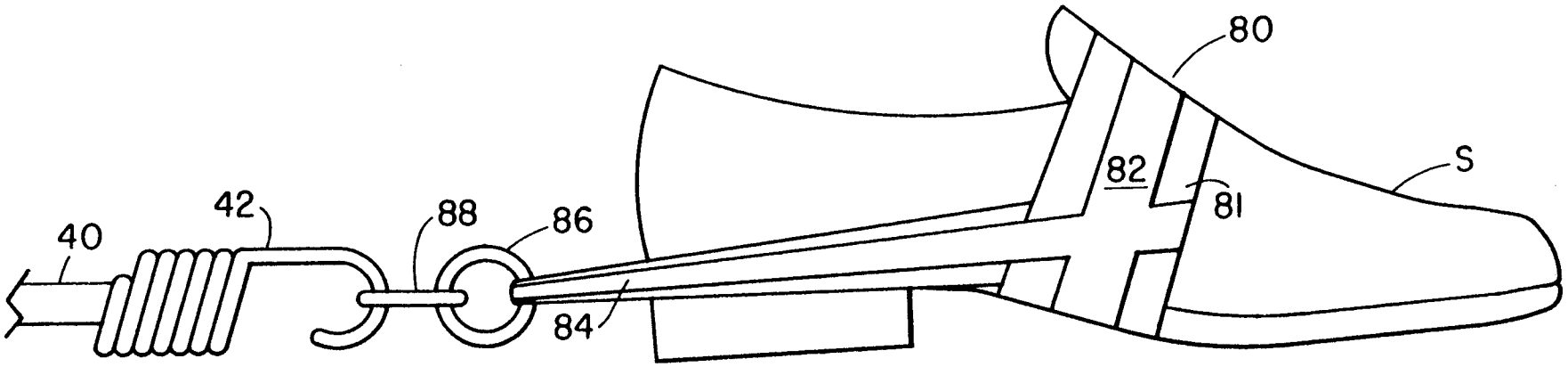
FIG. 3 is an elevational side view of the foot holster portion of this invention shown in use in FIG. 1D.

To provide leg exercises without stressing the back and arm muscles the foot holster 80, shown in FIG. 1D and in greater detail in FIG. 3, may be used. FIG. 1D shows a user seated upon a bench B in one of the preferred exercises that may be accomplished using the foot holster 80. As before different numbers of elastic bands 40, different stiffnesses of elastic bands 40, and different amounts of preload may be used to provide a wide variety of energy expenditures as desired.

FIG. 2 shows in more detail a preferred form of the invention. Handgrip 20 is generally rectangular so as to surround aperture 23 which is wide and deep enough to accommodate a users hands perhaps one atop the other or a users foot as described above in reference to the quadracep exercise. Grip bar 22 faces to the left in FIG. 2 and suitable cable attachment sockets 24 for multiple cables face to the right. The material used for the handgrip 20 is preferably a form of strong molded plastic but wood or any other lightweight material may be used. The multiple cable attachment sockets 24 are shown in more detail in FIGS. 4 and 5. There is shown provision for 5 separate cable attachments in the Figures but it will be obvious to one of ordinary skill that any number may be used with the upper limit being determined by the width of the elastic band attachment means. It is contemplated that at least ten cable attachment sockets could be fitted on a single hand grip.

Elastic cables 40 are shown in FIG. 2 as being ordinary bungy cords such as are readily available commercially. The advantage of using such cords would be that the user could easily replace any cords that might become overstressed or otherwise damaged. The circular elastic bungy cords are bound at each end by coiled retainers 42 which terminate in hooks suitable for attachment to the handgrip cable attachment sockets 24 or to the apertures formed on the anchor bracket 60.

Anchor bracket 60 is formed of a length of unequal leg angle iron or aluminum. If desired a suitable plastic molding might also be used for the anchor bracket 60 for economy and lightness. The long leg 61 of the angle is pierced by a series of holes 64 which correspond in number to the maximum number of bands or cables 40 to be used. The short leg 62 of the angle fits up against the side of a door opposite the user. This exceedingly simple anchor bracket 60 is a significant improvement of my invention over similar brackets used in the prior art. For one thing there is no provision of a means for locking the bracket 60 to the door except for the simple closing of the door D itself against its own door jamb. I have found that a more complex anchor is not needed for a single user exercise device.

FIG. 3 illustrates a foot holster 80 suitable for use as an easily detachable device for connecting the shoes of a user to an elastic band for ankle or leg exercising. The unshown end of elastic cable 40 band is understood to be attached to an anchor bracket 60 as describe above. Foot holster 80 is designed to allow the user to insert his foot into the forward loop portion 82 beneath cushion portion 81 so as to secure ring 86 to rear loop portion 84 of the foot holster 80. The purpose of the cushion 81 is to distribute the stresses over a wider area of the foot to prevent discomfort or marring of the shoe S. Ring 86 is provided as one simple means of providing an attachment point for a clip fastener 88 which in turn is attached to elastic cable retainer 42. Of course many other possible attachment variants will occur to one skilled in the art and the scope of my invention is intended to cover such variants. The shown use in FIG. 1D and FIG. 3 of the foot holster 80 as providing a rearward resistance to foot movement is not to be construed as limiting. Loop 84, for example, could be oriented vertically so as to provide vertical resistance to movement without substantial modification.

Figure 6:
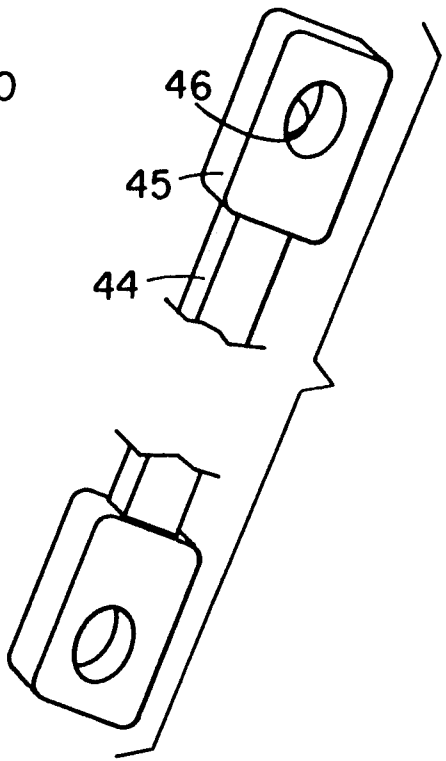
FIG. 6 is a broken perspective view of a preferred rectangular form of elastic strap for use with the handgrip of FIGS. 4 and 5.
Figure 5:
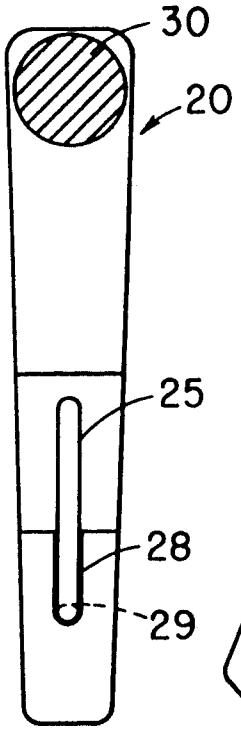
FIG. 5 is a side view of the handgrip as seen from the right of FIG. 4.
Figure 4:
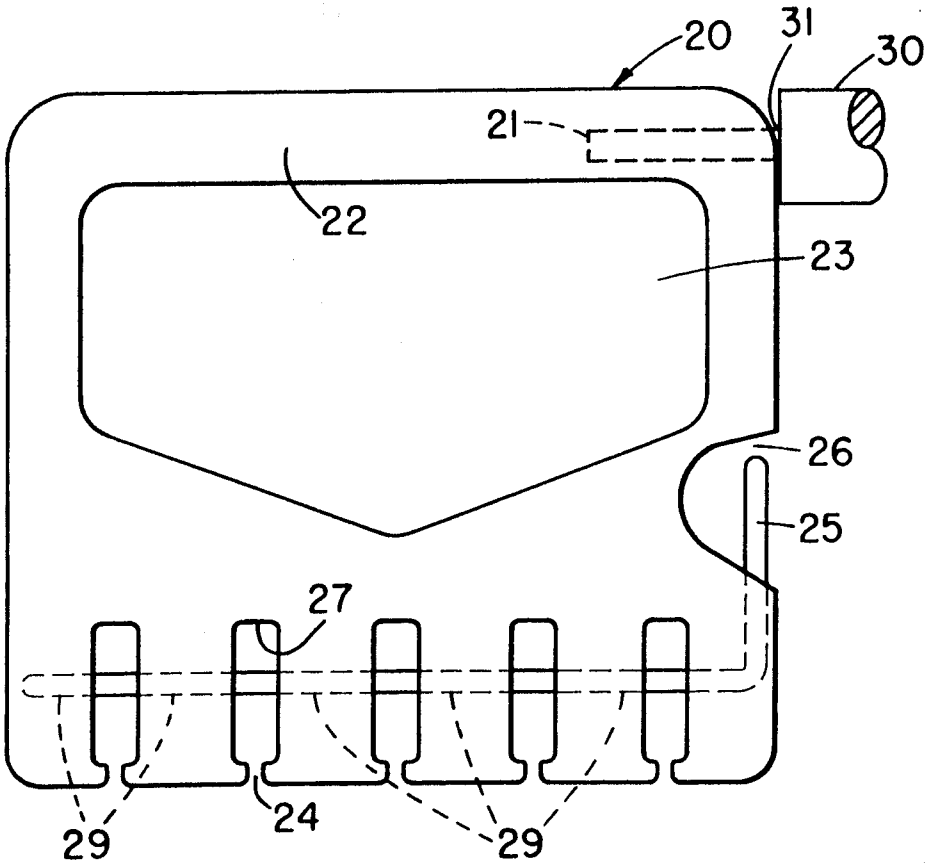
FIG. 4 is a plan view of the handgrip portion of the invention shown in use in FIGS. 1A-1C.

Turning now to FIGS. 4 and 5 handgrip 20 will now be described in greater detail. The grip bar portion 22 may be circular in cross-section but preferably is generally rectangular with rounded corners for the purpose to be described later with respect to foot plate 100 in FIGS. 9 and 10. The width of the main opening 23 is sufficient to allow the insertion of two hands the front portion of a shoe, or the rear of foot plate 100. One side of handgrip 20 has a cutout 26 to accommodate a short side of bent pin 25. Cable attachment sockets 24 are shown in greater detail in FIG. 4. It may be seen that a widened rectangular inner socket portion 27 is joined along a narrow side to a narrower slot portion of the socket 24. A through bore 29 (FIG. 5) passes through the central portion of all the rectangular inner socket portions 27 of which five are shown in FIG. 4. The long side of bent pin 25 is designed to pass through bore 29 as shown in FIG. 4 to provide a bridge across each of the widened rectangular inner socket portions 27. When the bent pin 25 has been inserted all the way into bore 29 the short side of the pin 25 is captured in keeper groove 28 in the side of handgrip 20 adjacent cutout 26. The keeper groove 28 is slightly narrower than the diameter of pin 25 so as to cause a snap fit when the pin 25 is in the fully engaged position. The purpose of cutout 26 is to provide a finger hold to disengage pin 25 from the snap fit in keeper groove 28. FIG. 6 shows a specially designed rectangular elastic strap 44 for use with the handgrip 20 of FIGS. 4 and 5. Widened rectangular end portions 45 are sized so as to be a snug fit in the widened rectangular inner socket portions 27 of handgrip 20. The widened rectangular end portions 45 are perforated by holes 46 to allow passage of bent pin 25 after an appropriate number of elastic straps 44 have been fitted to the handgrip 20. The diameter of holes 46 may be appreciably greater than that of bent pin 25 to allow for easy insertion of the pin. It should be pointed out that when the elastic band or strap 44 is stretched and end portion 45 begins to pull out of socket portion 27 the edge of hole 46 will be contacted by pin 25. This causes a localized compressive force in the rubber and thus causes it to expand in width. However the snug fit of the rectangular end 45 in the socket 27 prevents such expansion and instead serves to create an extremely tight friction fit between the handgrip 20 and the strap 44. In this manner the band 44 can stand very large tensile forces and still not be torn by the relatively narrow bent pin 25. It will also be noted that the portion of the bent pin 25 exposed within socket 27 make a convenient spot to hook the ends of a conventional bungy cord elastic band 40 if desired.

Another feature of handgrip 20, illustrated in FIGS. 4 and 5, is the provision of lateral hole 21 on the side of the handgrip 20 into grip bar portion 22. Hole 21 is of sufficient diameter to snugly accept a pin 31 extending from one end of a stabilizer bar 30 which is shown broken in FIG. 4. It will be easily understood without further graphical representation that bar 30 extends to a length of approximately the width of a users shoulders and has a similar pin member extending from its opposite end for insertion in a similar lateral hole in another handgrip member 20. The purpose of the stabilizer bar 30 is to cause two handgrip members 20 to be locked together for operation in unison and thus to stretch simultaneously the elastic bands 40 or 44 attached to both handgrip members 20. This stabilizer bar is best used in conjuction with the foot plate members described hereinafter.

Many useful and beneficial exercises can be acheived with the apparatus thus far described. One which might not be immediately obvious to the casual observer is placing both hands on one handgrip 20 attached at around hip height and pulling the elastic bands across and to the side of the body thus simulating the action of a two man cross cut saw. Another would be to attach two door anchors 60, one on each side near the bottom of the door. The user would then be seated facing the door D and, by stroking both handgrips 20 in unison, simulate a rowing action. The rowing exercise could be further enhanced by seating the user on a roller device such as a mechanics creeper, not shown.

Figure 7:
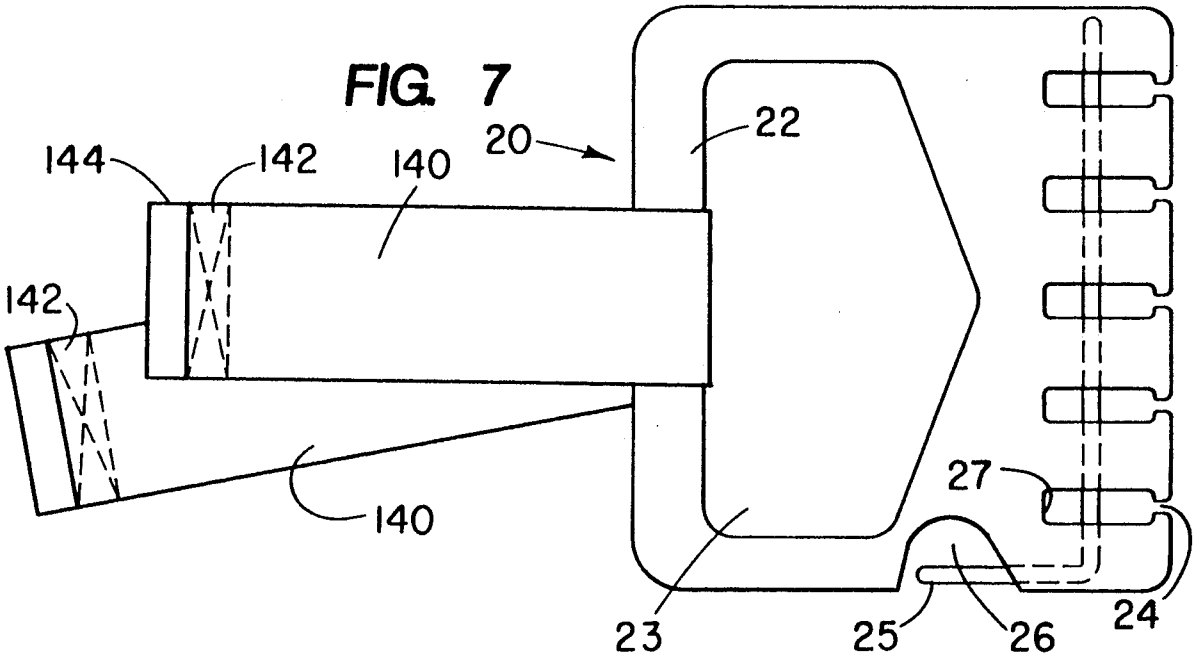
FIG. 7 is a top view of the handgrip of FIGS. 4 and 5 used in a different manner with an alternate form of elastic strap.

Turning now to FIG. 7 another variety of elastic strap is shown which utilizes its own anchor bracket and does not need a bracket such as bracket 60. This form of strap is in the form of a relatively wide and narrow band 140 which is preferably woven. Each end of the band 140 is looped around and stitched to itself as at 142. Within the stitched loop at the ends of the band 140 are fitted cylindrical keeper pins 144. If both ends of the strap or band 140 are placed around the edge of an open door and then the door D is closed, the keeper pins 144 will not pass through the normally small gap. Thus the handgrip 20, along with its elastic strap supports, may be supported on a door D in a semi-rigid fashion if the band 140 is made of sturdy nylon web type material. On the other hand, if the band 140 is made of elastic material the handgrip 20 can be used to stretch band 140 in the manner previously described with respect of bands 40 and 44. It will be noted that this embodiment of the invention does not require the anchor bracket 60 of the first described embodiment.

Figure 8A:
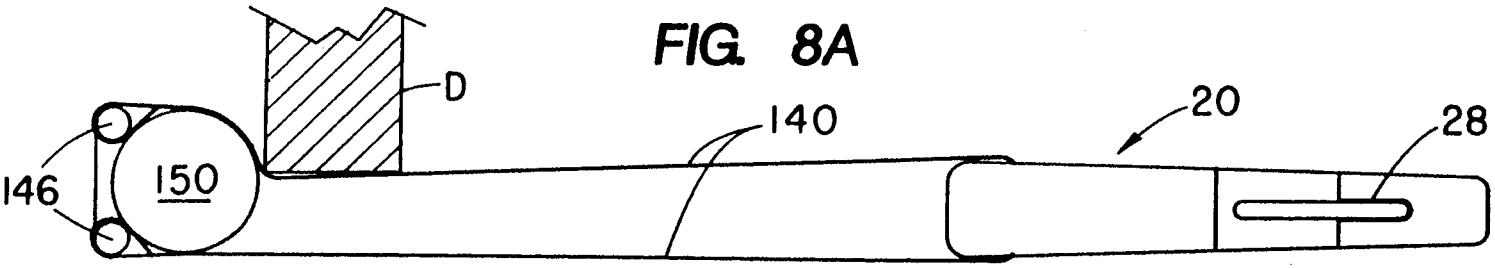
FIGS. 8A and 8B show rear and side views respectively of alternate structure for anchoring the strap of FIG. 7 beneath a door with a large bottom gap.
Figure 8B:
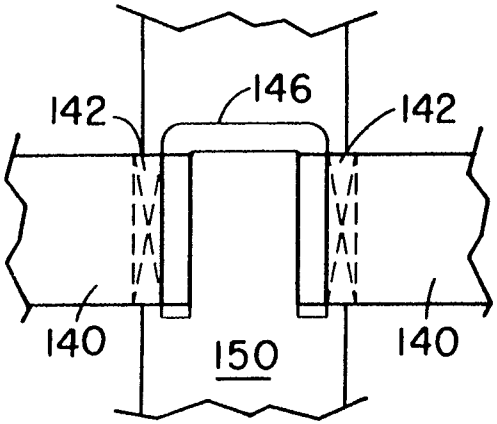

In some instances the gap at the lower edge of a door D is too great to capture the relatively small diameter keeper pins 144. The embodiment of FIGS. 8A and 8B show a variant designed to take care of just such a case. Individual keeper pins 144 are replaced by a single U shaped keeper pin 146 passing through both ends of the band 140. In this case it is also necessary to use a large diameter rod 150, such as a broomstick, to restrain the strap 140 on the far side of the door D. The restraint is clearly shown in FIG. 8A. Note if the strap 140 is elastic and the device is arranged under the door as shown in FIG. 8A, a user may perform a leg exercise as illustrated in FIG. 1D by inserting his foot through the aperture 20 in handgrip 23. Again note that no anchor bracket 60 is needed.

Figure 9:
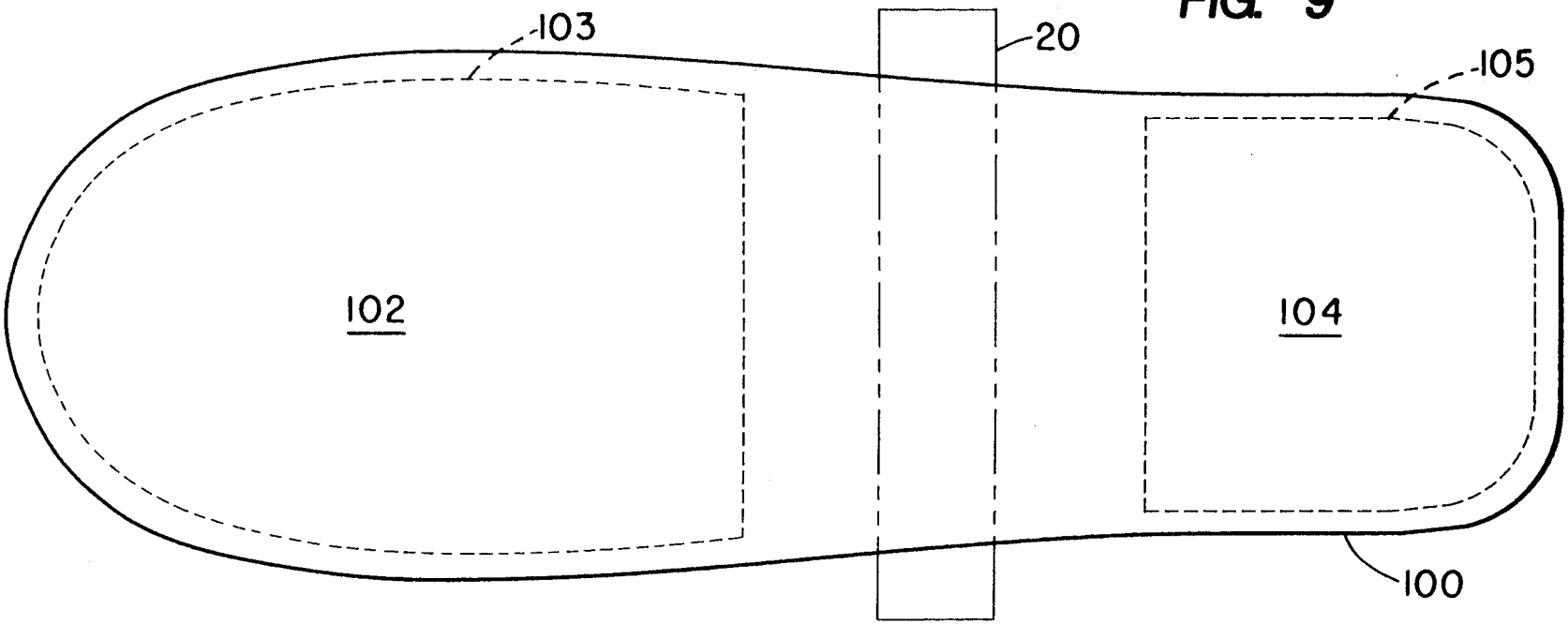
FIG. 9 is a top view of a rigid single foot plate anchor for use with the handgrip of FIGS. 4 and 5.
Figure 10:
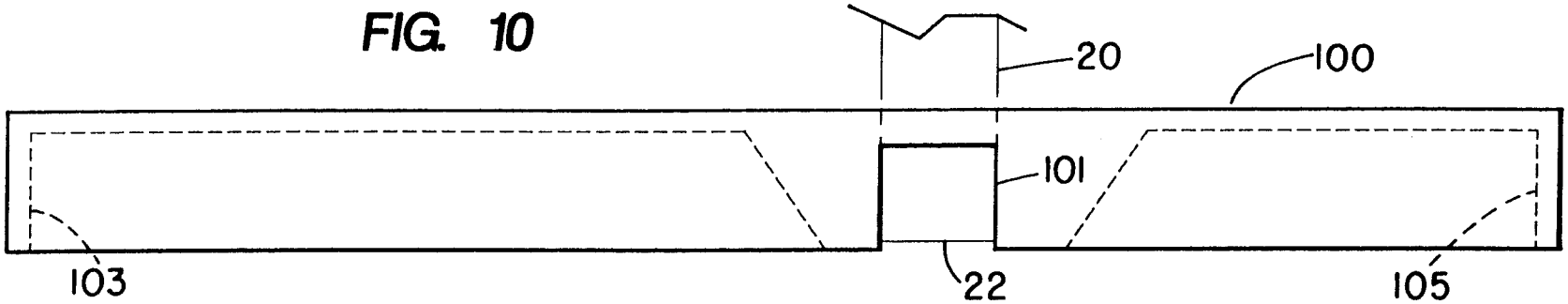
FIG. 10 is a side view of the single foot plate anchor of FIG. 9 showing the groove for holding the handgrip.

With all the flexibility of the door anchored devices described thus far, there is still one form of exercise, the straight lift, that is not possible to do with the door mounted anchor. This limitation is covered by the foot plate components of my invention shown in FIGS. 9–12. FIGS. 9 and 10 illustrate the top and side views, respectively, of a single foot plate 100 designed for use with handgrip 20 and allowing for straight lifting exercise thus simulating the lifting of weights. The foot plate 100 must be very rigid and light thus aluminum is a preferred material. The bottom of foot plate 100 has a rectangular notch 101 which is just big enough to accommodate the rectangular cross-section of the grip handle portion 22 of handgrip 20. The foot plate 100 has a toe portion 102 and a heel portion 104 both of which are hollowed out underneath as at 103, 105 to lessen the weight. The flat upper surface may be serrated or coated with abrasive material to provide a sure grip for the sole of the foot. The inverted handgrip 20 is placed beneath the foot plate 100 on the floor and the user stands upon the plate while pulling upward on the straps 40, 44, 140 attached as before to the handgrip 20.

Figure 11:
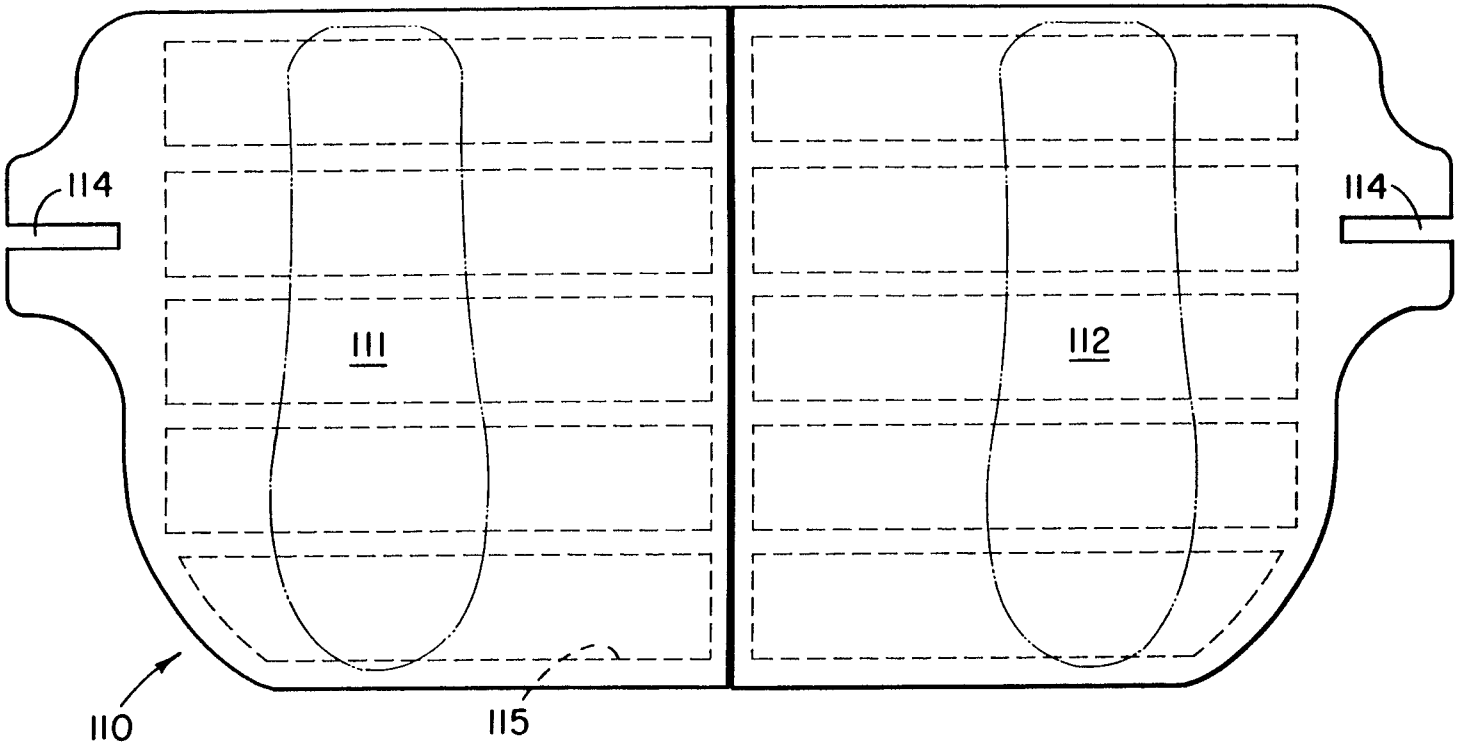
FIG. 11 is a top view of a hinged dual foot plate anchor for use with wide elastic straps such as shown in FIG. 7.
Figure 12:
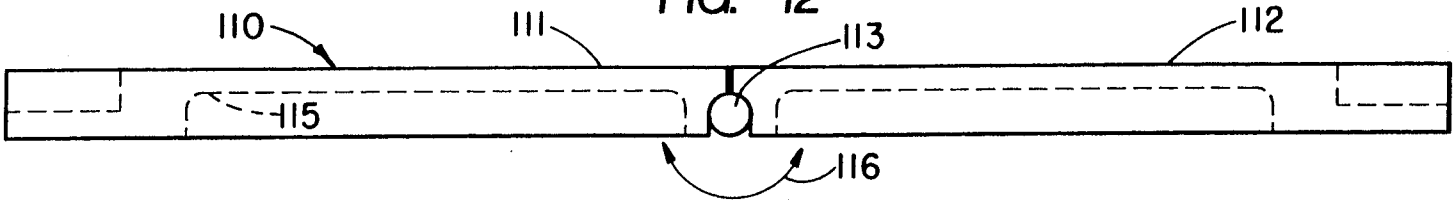
FIG. 12 is an end view of the hinged double foot plate anchor of FIG. 11.

A variation of the foot plate is shown in FIGS. 11 and 12. In this dual foot plate 110 two individual plates 111 and 112 are hinged together along hinge 113. Attachment slots 114 on the edges furthest from the hinge 113 are adapted to receive elastic straps as shown before in several embodiments. Several grooves 115 are milled or molded into the bottom surface of the dual foot plate 110 to reduce the weight. For portability the plate 110 is folded together along arrows 116 after use to fit conveniently into an attache case or gym bag. The dual foot plate 110 allows full two handed lift exercises to be performed simulating heavy weight lifting.

Figure 13:
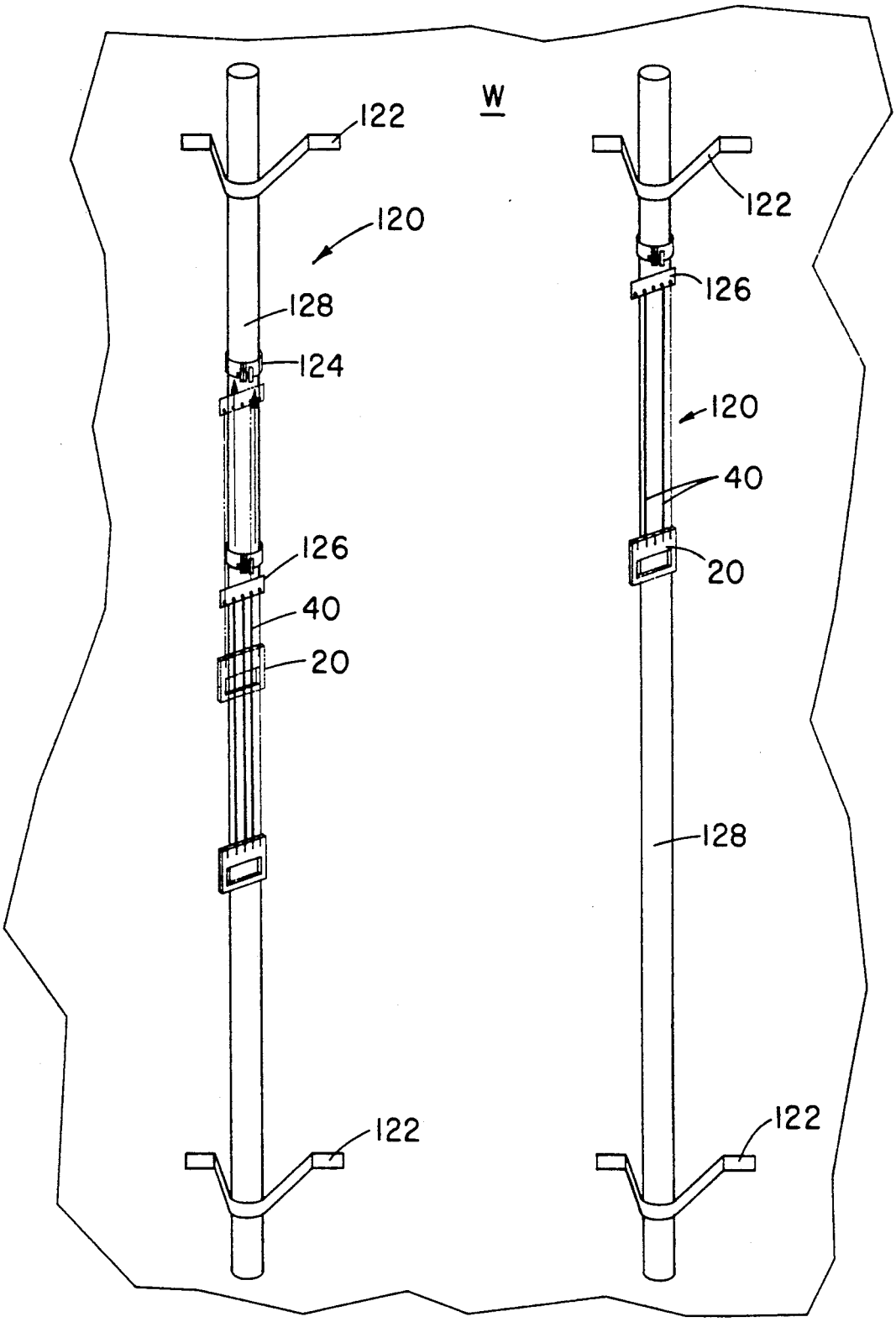
FIG. 13 is a perspective view of a semipermanent wall mounted adjustable anchor.

FIG. 13 shows a semi-permanent form of anchor device 120 which may be mounted upon a wall W or upon a door D. Long cylindrical tube 128 is mounted offset from a wall W by brackets 122. Adjustable hangers 124 are adapted to be adjustably fixed to tube 128. Anchor brackets 126 are supported on the adjustable hangers 124 and are adapted with strap attachment holes similar to those on anchor bracket 60. The straps 40 and handgrips 20 are similar to those already described. Two such anchor devices 120 are shown mounted side by side in FIG. 13.

It is to be understood that the present invention is not limited to the sole embodiment described above, but encompasses any and all embodiments within the scope of the following claims.

I claim:

1. A portable exercise gym kit transportable in a conventional container, said exercise gym kit comprising:

at least one handgrip means including releasable attachment means for attaching multiple elastic tension straps thereto at one longitudinal end thereof, an aperture centrally disposed to selectively and alternatively accommodate a hand and a foot of a user, and grip bar means at a second longitudinal end opposite said one longitudinal end, said grip bar means forming one side of said aperture;

at least one anchor bracket means formed of an angle iron including a series of holes bored in a line along one leg of said angle iron to provide attachment points;

a plurality of elastic tension straps each having connecting means on one end selectively engageable with said releasable attachment means on said handgrip means, and connecting means on a second end opposite said one end selectively engageable with said holes in said anchor bracket means;

at least one foot holster means for engaging a foot of a user and having releasable engagement means selectively engageable with at least one of said connecting means of said plurality of elastic tension straps;

at least one rigid foot plate means selectively mountable through said aperture of said at least one handgrip means;

at least one hinged rigid dual foot plate means having positions for each foot upon which the user stands and selectively engageable with said connecting means on said plurality of elastic tension straps;

at least one wide elastic tension strap selectively passed through said aperture in said handgrip means and having loops sewn in each end of said wide elastic tension strap;

at least two straight keeper pins selectively insertable in said loops of said at least one wide elastic tension strap;

at least one U-shaped keeper pin, each leg thereof being selectively insertable in one of said loops of said at least one wide elastic tension straps to form a closed loop of said at least one wide elastic tension strap; and at least one dowel selectively insertable within said closed loop of said at least one wide elastic tension strap; whereby said handgrip means, said anchor bracket means, said plurality of elastic tension straps, said foot holster means, said hinged rigid dual foot plate means, said wide elastic tension strap, said straight keeper pins, said U-shaped keeper pin and said dowel may be easily transportable in any suitable container to enable a user to exercise in any selected environment by selectively connecting the several elements to provide selective exercises and suitable anchoring.

2. A portable exercise gym kit as in claim 1, wherein:

said connecting means on one end of said plurality of elastic tension straps comprise a widened rectangular end portion with an aperture therethrough, said aperture being located centrally within said widened rectangular portion; and said releasable attachment means comprises:

a series of rectangular notches the long axis of which is generally perpendicular to the axis of said grip bar means, each said notch being just large enough to snugly accommodate said widened rectangular end portion of one of said elastic tension straps;

a bore passing through said handgrip means parallel to said grip bar means substantially located centrally of said rectangular notches and an external groove on a side of said handgrip means perpendicular to said grip bar means; and an L-shaped pin comprising a long side and a short side, said long side extending through said bore after said widened rectangular ends of said plurality of elastic tension straps have been fitted into said rectangular notches and thereby also passing through said apertures in said widened ends of said elastic tension straps so as to prevent the separation of said elastic tension straps from said handgrip means, and said short side resting in said external groove in said handgrip means when said long side has been passed through said bore so as to present a smooth external surface during use of said portable exercise gym; whereby said elastic tension straps are selectively and suitably attached to said handgrip means.

3. A portable exercise gym kit as in claim 2; wherein said side of said handgrip means containing said external groove also contains a notch lying beneath said short side of said L-shaped pin sufficiently deep to enable a user to manually remove said L-shaped pin from said handgrip means to release said elastic tension straps from said handgrip means.

4. A portable exercise gym kit as in claim 3, wherein said connecting means on said second end of said plurality of elastic tension straps comprise hooks engageable with an anchor means, whereby exercise may be achieved by working against the bias of said elastic tension straps.

5. A portable exercise gym kit as in claim 4, wherein said anchor means comprises said angle iron, said hooks being inserted through said series of holes, whereby anchoring is achieved by mounting said angle iron on a door which is thereafter closed to hold said angle iron in position.

6. A portable exercise gym kit as in claim 4, said hooks being inserted in a clip fastener on said foot holster means comprising said anchor means, said handgrip means being connected to said wide elastic tension strap, at least one of said keeper pin means forming a portion of a second anchor means held by a closed door, to enable leg exercises to be achieved.

7. A portable exercise gym kit as in claim 6, wherein said keeper pin means comprises two straight keeper pins insertable in said loops of said wide elastic tension strap.

8. A portable exercise gym kit as in claim 6, wherein said keeper pin means comprises a U-shaped keeper pin, each leg thereof being inserted into one of said loops to form a closed loop of said at least one wide elastic tension strap, said dowel being insertable within said closed loop to anchor said closed loop behind a closed door.

9. A portable exercise gym kit as in claim 4, wherein said anchor means comprises a second handgrip means, said plurality of elastic straps passing around a groove provided in the base of said rigid foot plate means, whereby the weight of the user anchors the portable exercise gym.

10. A portable exercise gym kit as in claim 4, wherein said anchor means comprises said hinged rigid dual foot plate, said hooks being attached to slots in said hinged rigid dual foot plate.

11. A portable exercise gym kit as in claim 1, wherein the connecting means on one end and on a second end of at least some of said plurality of elastic tension straps are hooks, whereby said at least some of said plurality of elastic tension straps are connectable at said one end of said foot holster means and are connectable at said second end to said angle iron, whereby said elastic tension straps are anchored during leg exercises.

12. A portable exercise gym kit as in claim 1, further including means for mounting selected components of said portable exercise gym kit comprising a long cylindrical tube, brackets for mounting said tube on said wall, and adjustable hangers for mounting selected components of said portable exercise gym kit on said cylindrical tube.

* * * * *